United States Patent [19]

Jenkins et al.

[11] 4,199,823

[45] Apr. 29, 1980

[54] DISENGAGEABLE HELMET VISOR CLAMP

[75] Inventors: Alan N. Jenkins, Kenilworth; Michael Taylor, Lower Norton, Near Warwick, both of England

[73] Assignee: Helmets Limited, Hertfordshire, England

[21] Appl. No.: 854,128

[22] Filed: Nov. 23, 1977

[51] Int. Cl.[2] ..... A42B 3/02

[52] U.S. Cl. ..... 2/424; 2/6

[58] Field of Search ..... 2/424, 423, 422, 425, 2/15, 427, 6, 8, 9, 10

[56] References Cited

U.S. PATENT DOCUMENTS

| | | | |
|---|---|---|---|
| 2,798,221 | 7/1957 | Bailey et al. | 2/6 |
| 3,066,305 | 12/1962 | Aileo | 2/6 X |
| 3,487,470 | 1/1970 | Stapenhill | 2/6 |
| 3,543,308 | 12/1970 | Stapenhill | 2/6 |
| 3,593,338 | 7/1971 | Penny | 2/6 |
| 3,631,540 | 1/1972 | Penny | 2/6 |

FOREIGN PATENT DOCUMENTS

| | | | |
|---|---|---|---|
| 2736121 | 2/1978 | Fed. Rep. of Germany | 2/424 |

*Primary Examiner*—Werner H. Schroeder
*Assistant Examiner*—Andrew M. Falik
*Attorney, Agent, or Firm*—Ira Milton Jones

[57] ABSTRACT

The mounting for a visor of a helmet comprises an arcuate track located at the side of the rigid headshell and centered on the visor axis, a shoe connected with the visor and movable along the track, a control element for moving the shoe and hence the visor and means for clamping the shoe to the track. Initial movement of the control element relative to the shoe serves to release the clamping means which may comprise rollers wedging between inclined surfaces of the shoe and the opposing track surface. The visor can be replaced by other helmet borne equipment.

18 Claims, 9 Drawing Figures

DISENGAGEABLE HELMET VISOR CLAMP

This invention relates to protective helmets comprising a rigid headshell and optical means such as a visor carried on the head shell for rotational movement into and out of the line of sight of the helmet wearer about an axis extending transversely of the head shell. In a helmet used by aircrew, the optical means is typically a blast visor or a tinted glare visor, but the invention is also applicable to the mounting on the helmet head shell of other optical means which require for operation to be brought into the wearer's line of sight by rotational movement about a transverse axis, for example binoculars, sights and shields.

The rotational movement of, for example, the glare visor on a helmet used by aircrew is normally effected by means of a frictionally held pivotal mounting which enables the visor to be located at any position intermediate its extremities of movement. In certain circumstances the forces acting on such a visor are considerable and movement of the visor by the wearer is rendered difficult. It is an object of the present invention to provide a protective helmet of the kind referred to in which adjustment of the visor or other optical means to any position between its extremities of rotational movement is facilitated.

Accordingly, the present invention consists in a protective helmet comprising a rigid head shell; optical means carried on the head shell for rotational movement into and out of the line of sight of the helmet wearer about an axis extending transversely of the head shell and a mounting for supporting the optical means on the head shell, wherein said mounting comprises an arcuate track fixed relatively to and located at a side of the head shell and centred on the rotational axis of the optical means, a shoe connected with the optical means for movement along the track upon said rotational movement of the optical means, clamping means provided between the shoe and the track and a control element arranged for limited movement relative to the shoe, said clamping means being adapted upon movement of the control element in either of two opposite senses to free the shoe with respect to the track so enabling rotational movement of the optical means to be effected by further movement of the control element and upon cessation of movement of the control element to clamp the shoe to the track.

Suitably, clamping means comprises opposed mutually spaced surfaces of the track and the shoe of which the shoe surface at opposite ends thereof is inclined in respective opposite senses relatively to the track surface, and wedging elements located between said spaced surfaces of the shoe and the track and biassed into engagement with the track surface and the respective inclined ends of the shoe surface.

Advantageously, the wedging elements comprise ball or roller elements spring biassed into engagement with the track surface and the respective inclined ends of the shoe surface.

The invention will now be described by way of example with reference to the accompanying drawings in which.

Figure 1:
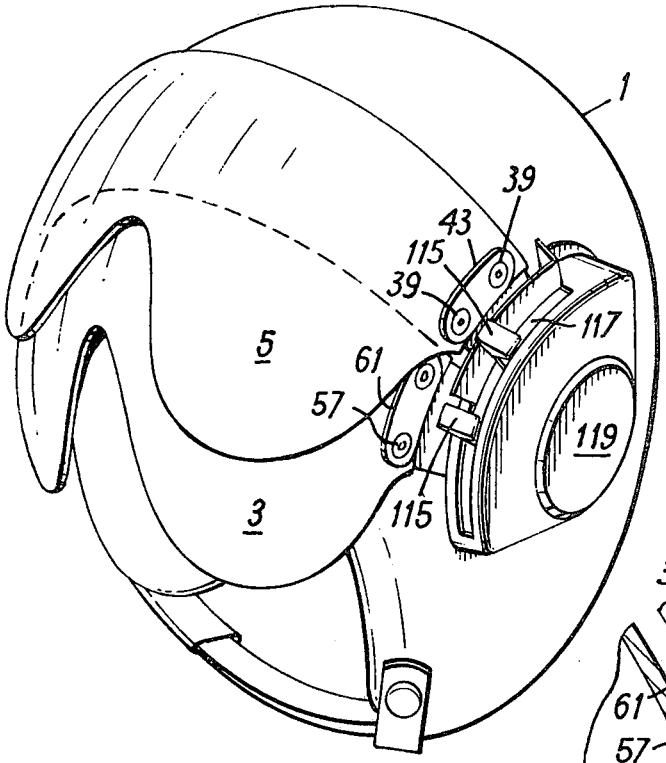
FIG. 1 is a perspective view of a protective helmet according to the invention.
Figure 2:
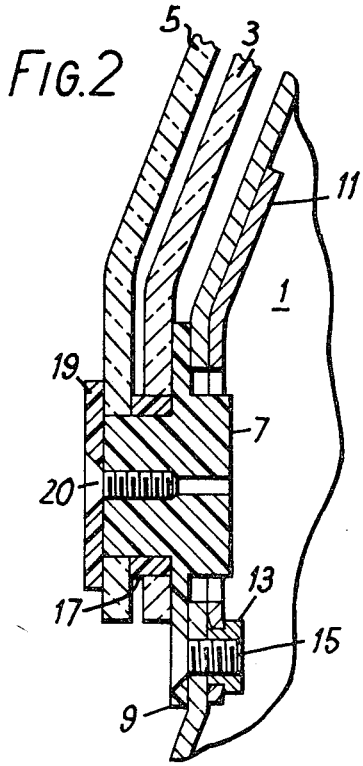
FIGS. 2 and 3 are sectional front views of parts of the helmet shown in FIG. 1.
Figure 4:
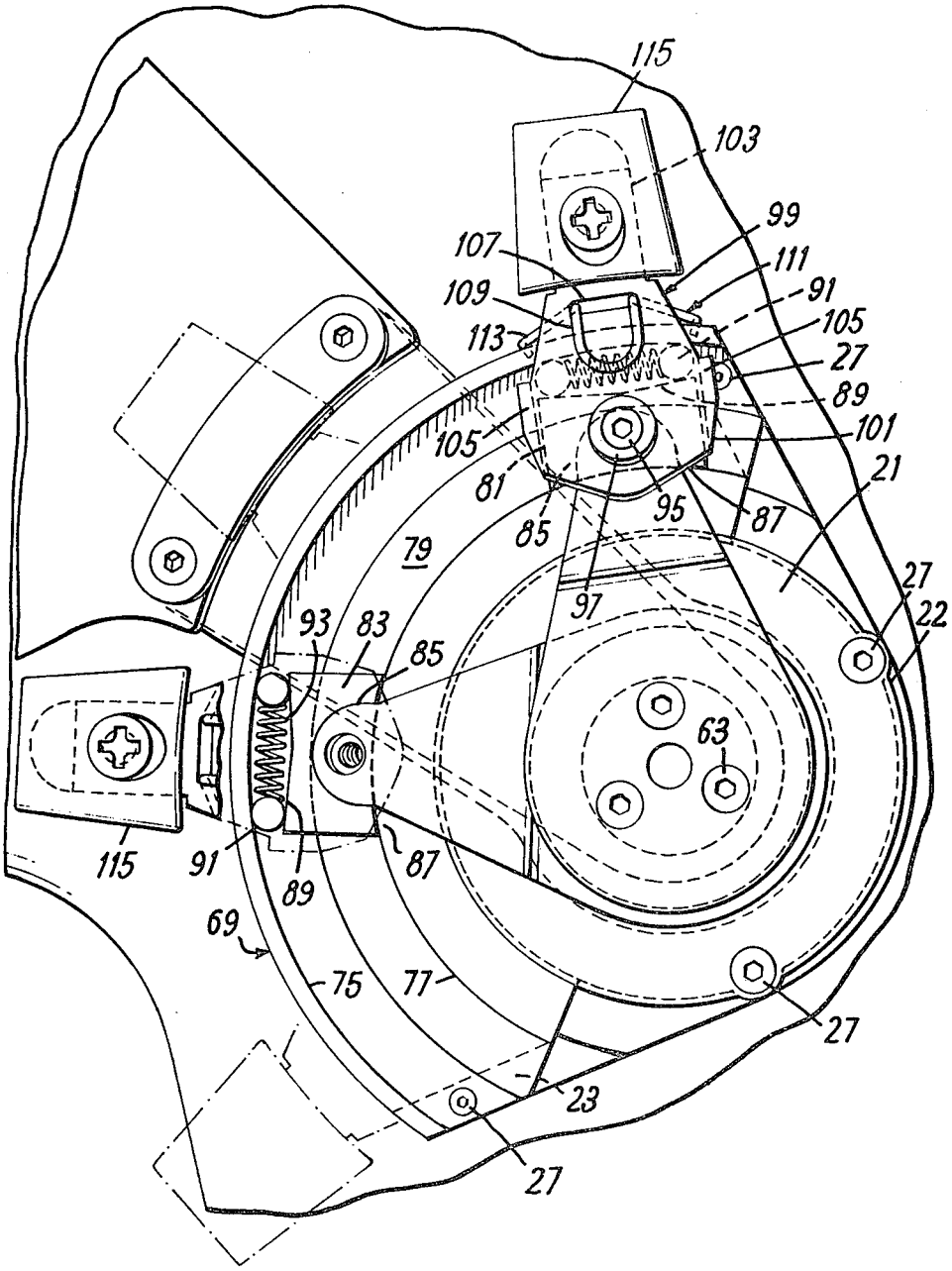
Figure 5:
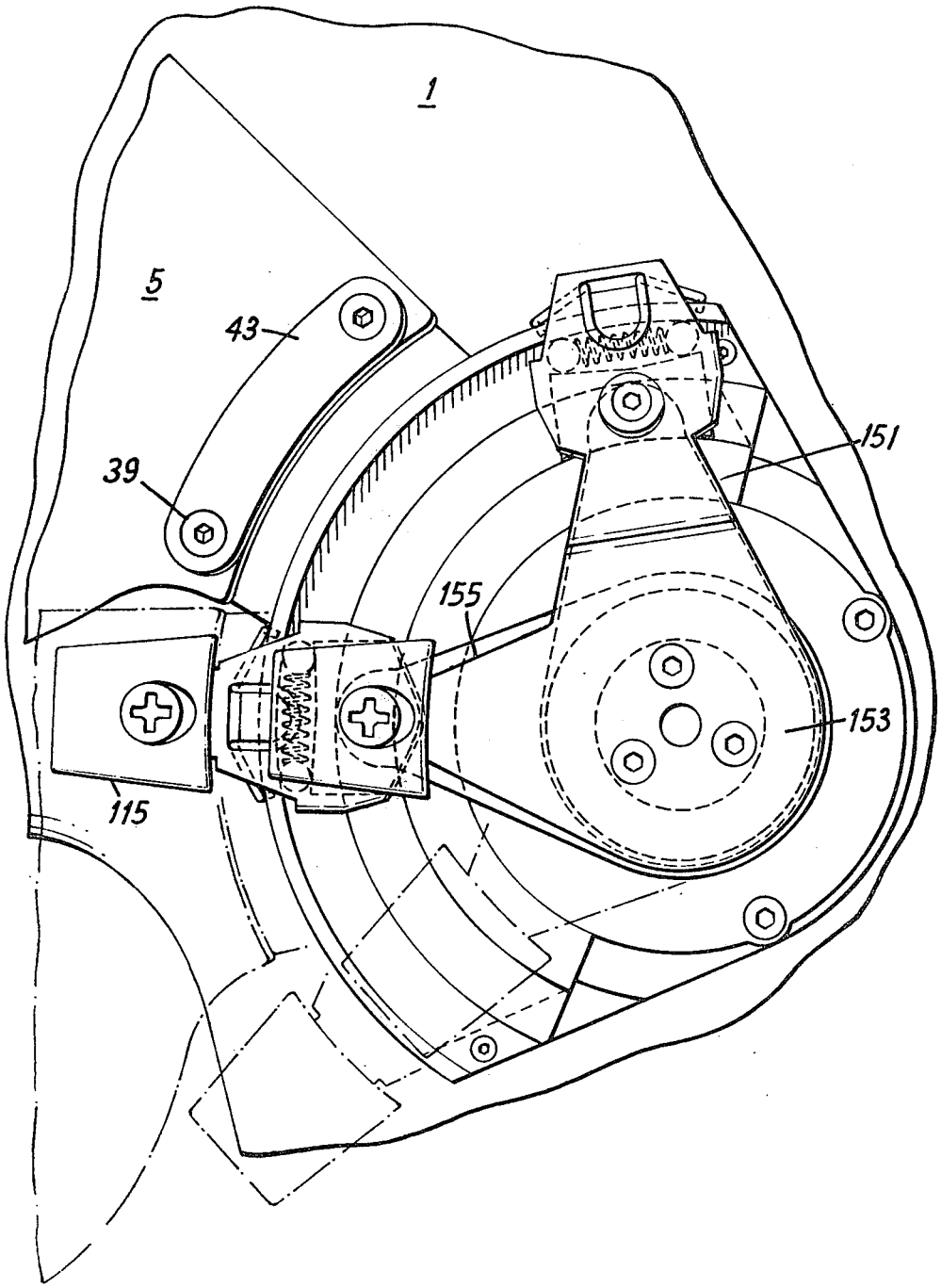
Figure 6:
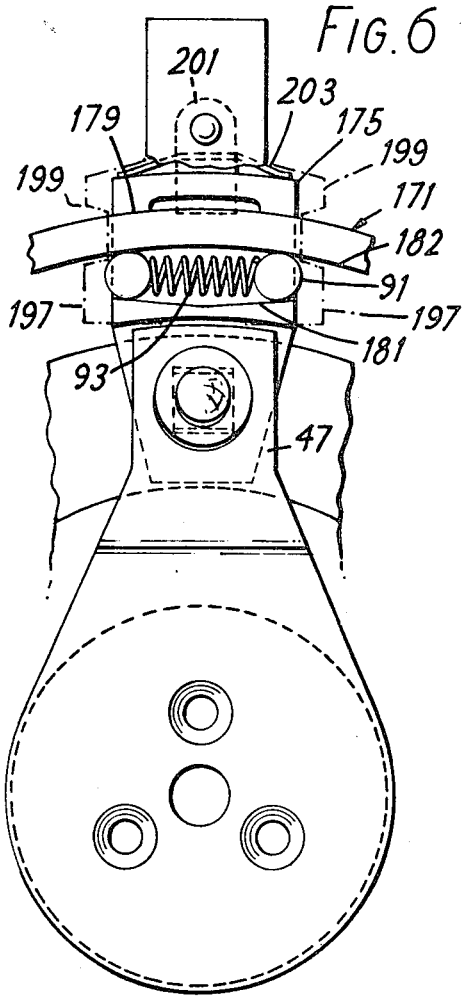
Figure 7:
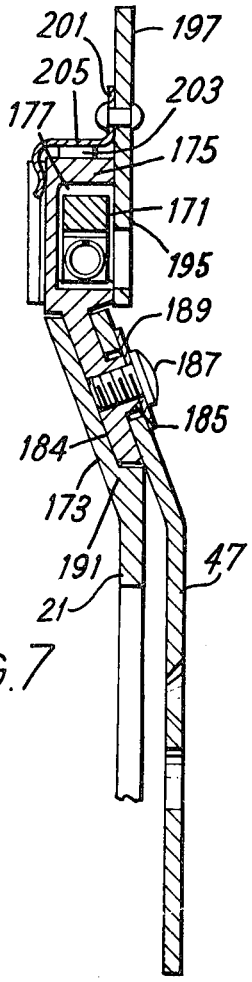
Figure 8:
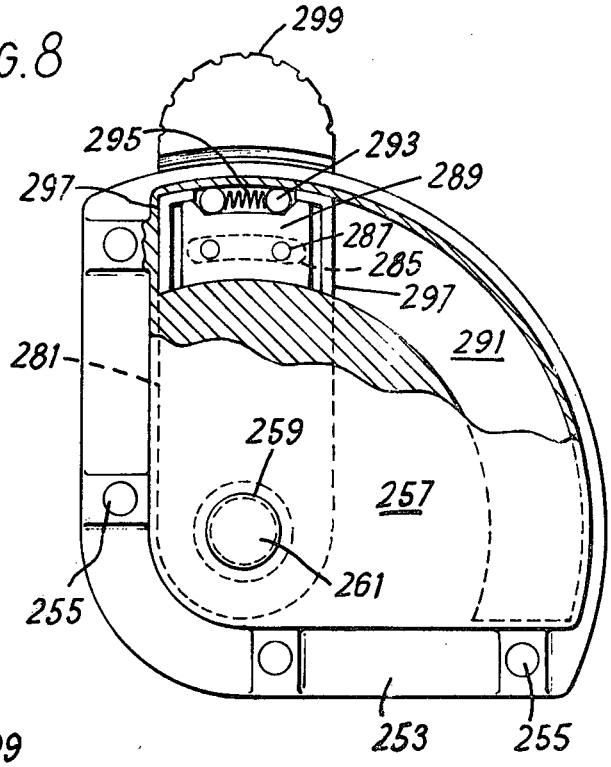
Figure 9:
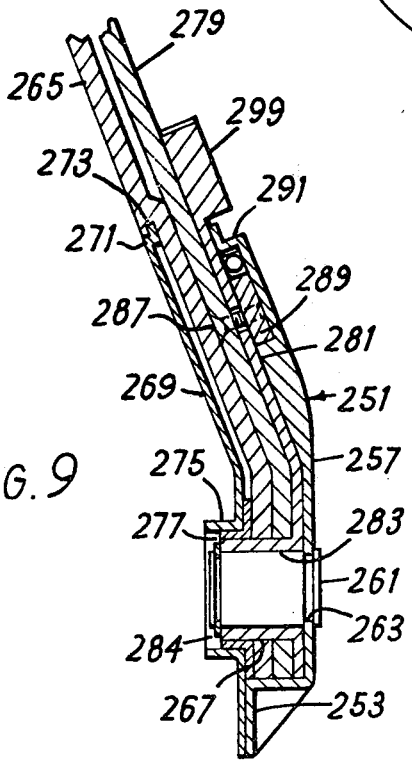

FIG. 4 is a side elevation with certain parts removed of the helmet shown in FIG. 1, FIG. 5 is a view similar to FIG. 4 but showing a modification, FIGS. 6 and 7 are side and front sectional views respectively of parts of a further helmet according to the invention, and FIGS. 8 and 9 are side and front sectional views respectively of similar parts of still a further helmet according to the invention.

The protective helmet comprises a rigid head shell 1, to which are mounted an inner blast visor 3 and an outer glare visor 5, for independent rotation about an axis extending transversely of the head shell. At one side of the helmet there is provided a pivot boss 7 which is located within an aperture formed in the head shell and which comprises an integral flange 9 abutting the exterior surface of the head shell. A mounting plate 11 having an aperture aligned with the aperture of the head shell engages the interior surface of the head shell around the pivot boss 7 and is provided with internally threaded anchor bushes 13 which receive screws 15 passing through the flange 9 and the head shell. An annular spacer 17 is located on the pivot boss 7 and provides a bearing surface for the blast visor 3 which is formed with a complementary circular aperture. The glare visor 5 is provided with an aperture of smaller diameter and engages the pivot boss 7 directly. An end plate 19 is secured with screw 20 to the pivot boss 7 so preventing outward movement of the glare visor. Inward movement of the glare visor is prevented by the spacer 17.

At the side of the helmet remote from the pivot boss 7 there is provided a plastics quadrant plate 21 having an inwardly directed rim 22 extending continuously around the two substantially straight edges of the quadrant and their intersection. The rim 22 extends radially of the quadrant at either end of the arc to provide rim projections 23. A mounting plate 25 is positioned against the interior surface of the head shell and the quadrant plate 21 is held in place by screws 27 which pass through the rim 22, the head shell and the mounting plate 25. The quadrant plate 21 is formed with a circular aperture centered on the transverse axis about which the two visors rotate. Within this aperture is rotably mounted an outer bearing sleeve 29 having an integral flange 31 engaging the periphery of the quadrant plate aperture via a bush 33. A glare visor mounting arm 35 is secured to the inner end face of the outer bearing sleeve 29 with screws 37 and is connected at its free end with the glare visor 5 by means of two screws 39 which pass through holes in the glare visor to engage anchor bushes 41 secured to the mounting arm 35. A fish plate 43 is located beneath the heads of screws 39. To the outermost end face of the outer bearing sleeve 29 is secured by means of screws 45, a shoe support lever 47 to be described more fully hereinafter.

Concentrically within the outer bearing sleeve 29 there is positioned an inner bearing sleeve 49, the two sleeves being freely rotatable relative to one another. A flange 51 integral with the inner bearing sleeve 49 is sandwiched between the glare visor mounting arm 35 and a blast visor mounting arm 53 which is secured to the inner bearing sleeve 49 with screws 55. The blast visor 3 is secured to its mounting arm 53 in similar fashion to the glare visor 5, with screws 57, anchor bushes 59 and a fish plate 61. To the outer end face of the inner bearing sleeve 49 is secured with screws 63 a second shoe support lever 65 positioned outwardly of the first shoe support lever 47, there being provided a bush 67 to ensure sufficient axial clearance between the two levers.

Around the curved periphery of the quadrant plate 21 there is secured an arcuate track in the form of a metallic channel 69. The track is provided with a circumferentially extending shoulder 71 which overlies a complementarily shaped shoulder 73 of the quadrant plate and is held in place by the two screws 27 at each end of the track which also serve to mount the quadrant plate on the head shell. In this way the track 69 is spaced from the head shell and does not interfere with rotation of the glare and blast visor mounting arms 35 and 53 respectively. The two interior wall surfaces 75 and 77 of the track channel lie on respective cylindrical surfaces coaxial with the transverse axis about which the two visors rotate, and the base 79 of the channel is of chevron formation. Within the track channel are located two shoes 81 and 83 associated with the respective shoe support levers 65 and 47. These two shoes and the mechanisms of which they respectively form part are substantially identical and only those parts pertaining to movement and clamping of the blast visor 3 will be fully described.

The inner face of shoe 81 is contoured to engage the base of track channel 69 and the outer face is provided with a substantially semi-circular cut-out 85 to receive the rounded end of shoe support lever 47. The radially inner edge surface 87 of the shoe is arcuate to conform with the interior wall surface 77 of the track channel and the radially outer edge surface 89 is inclined at its two ends circumferentially outward of the shoe and toward the interior wall surface 75 of the track. Between the shoe surface 89 and the track surface 75 are positioned two roller elements 91 having their axes parallel with the transverse axis of rotation of the visors. A compression spring 93 acting between the two roller elements 91 serves to bias the roller elements into engagement with the track surface 75 and the respective inclined ends of the shoe surface 89 and, in the clamping position shown in the drawings, each roller element projects slightly beyond the shoe surface 89. At the centre of the semi-circular cut-out 85, the shoe 81 is provided with a tapped hole into which is threaded a screw 95 with a bush 97. The screw 95 and bush 97 pass through an aperture in the rounded end of the shoe support lever 47 to secure the shoe to the lever but also provide pivotal mounting for a control element 99.

The control element comprises a plate 101 formed at the radially outward end as a rectangular tongue 103 and having side portions 105 bent inwardly of track one each side of the shoe 81. The two side portions extend adjacent and parallel to the respective radial edges of the shoe 81 but extend a short distance beyond the shoe in the radial direction so as to be engageable with the roller elements 91. The plate 101 has an elongate slot 107 through which is passed the central U-shaped portion 109 of a retaining spring 111. At either end of the U-shaped portion the spring is provided with a hook member 113 which grips the track 69 to prevent outward bending movement of the control element 99. A knob 115 is screwed to the tongue 103 of the control element, and projects through an arcuate slot 117 formed in cover 119 which for clarity is not shown in FIGS. 3 and 4. The cover 119 is secured to the head shell directly and is suitably contoured to enclose the track 69 and associated mechanism while increasing the transverse width of the helmet as little as possible.

The manner in which the described mechanism operates can now be understood. In normal use of the helmet the shoe 81 is clamped to the track 69 and any tendency for the shoe to move will cause the rearmost roller element 91 in the direction of this movement to ride further up the corresponding inclined end of the shoe thus increasing the wedging effect between track surface 75 and shoe surface 89. Since the shoe 81 is rigidly connected via shoe support lever 65, inner bearing sleeve 49 and blast visor mounting arm 53 with the blast visor 3, the visor itself is clamped in position. The glare visor 5 is similarly clamped by means of glare visor mounting arm 35, inner bearing sleeve 29, shoe support lever 65 and shoe 83 with the associated clamping means.

To move the blast visor 3 from, say, an upper inoperative position into a position in which it lies in the line of sight of the wearer, the control element 99 is moved via knob 115 in the corresponding sense along the track 69. The initial movement of the control element 99 is a pivotal movement relative to the shoe 81 about the bush 97 and the shoe remains clamped to the track. During this limited movement the rearmost side portion 105 in the direction of movement engages the adjacent roller element 91 and forces this roller down the inclined end of the shoe surface 89 against the bias of compression spring 93 and out of wedging engagement with the opposed shoe and track surfaces. The side portion 105 then abuts against the shoe 81 itself and continued movement of the knob 115 moves the shoe and hence the blast visor 3 to the required position. The limited movement relative to the shoe which is required of the control element to dislodge the roller from wedging engagement is relatively small and the initial and further movements of the control element, so far as concerns movement of the knob 115 by the helmet wearer, are substantially continuous. It will be appreciated that the foremost roller element in the direction of movement will of itself tend to roll down the associated inclined surface and will offer no resistance to movement. When the knob 115 is released the compression spring 93 will act to return both roller elements into their respective wedging positions and the control element will be automatically centralised relative to the shoe. Movement of the blast visor in the opposite sense is achieved in an exactly analogous manner with the two roller elements interchanging their rearmost and foremost roles.

There is shown in FIG. 5 a modification to the helmet shown in FIGS. 1 to 4. With the mechanism as previously described the two knobs 115 for movement of the glare and blast visor respectively move in circumferentially spaced arcs of the same circle. It is in certain circumstances advantageous to have the two knobs moving side by side in circumferentially aligned arcs of respective axially spaced circles and the FIG. 5 modification is made to this end.

As shown in FIG. 5, the control element 99 of the glare visor remains, as before, pivotally connected to the shoe support lever 47, but the other control element is now formed at the end of one arm 151 of a cranked lever 153 which is mounted for rotation about the transverse axis of the helmet. The other arm 155 of the cranked lever is provided with a tongue (not shown) for support of the knob 115. All other parts of this modified helmet are as previously described, with the exception that the two arcuate slots 117 in the cover 119 are placed side by side to accommodate the new position of the knobs, and the operation is completely analogous. The effect of mounting one control element 99 and its knob 115 on respective arms of a cranked lever, is that when the two visors are in corresponding positions the respective knobs are aligned circumferentially of the track with a slight axial separation. With this arrangement it is, for example, straightforward to move both knobs simultaneously, should this be required.

Figure 3:
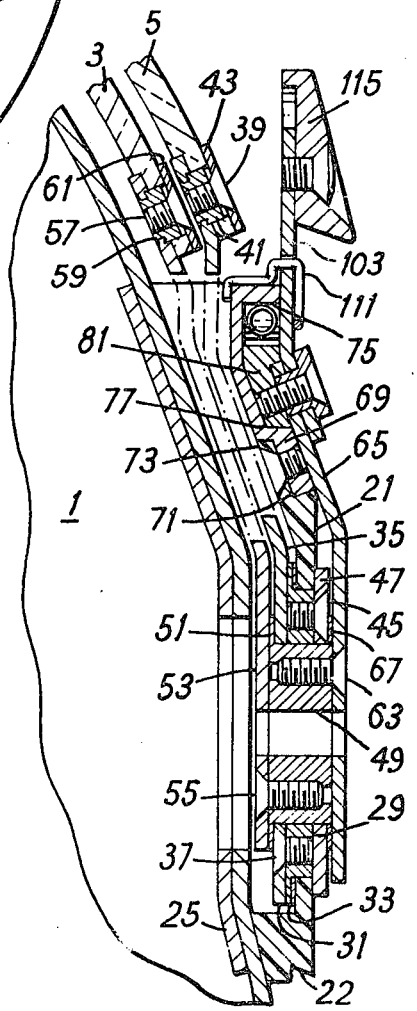

FIGS. 6 and 7 are views corresponding respectively with parts of FIGS. 3 and 4 showing a further modification. In this embodiment the track comprises an arcuate rail 171 of square cross section which is supported at its ends (not shown) from a radial edge portion 173 of the quadrant plate. For increased rigidity, the rail 171 can also be supported at its mid-length provided that the point of support is chosen so as not to interfere with the movement of the two shoes. As shown best in FIG. 7 the modified shoe 175 is formed with a recess 177 to accommodate the rail 171. The recess provides a radially inwardly directed arcuate surface 179 for cooperation with the outer curved surface of the rail 171 and a radially outwardly directed surface 181 which is inclined at opposite ends toward the opposed surface 182 of the rail. Between the facing surfaces of the rail and the shoe are positioned two roller elements 91 and a compression spring 93 as before.

The shoe 175 has a mounting flange 184 which extends towards the transverse axis of the helmet and which is provided with an integral bush 185 positioned within an aperture of the shoe support lever 47. A screw 187 and washer 189 complete the connection of the shoe to its support lever. To ensure that the shoe moves along its correct arc, the mounting flange 184 runs in a complementary groove 191 formed in the edge portion 173 of the quadrant plate 21. The modified control element 193 comprises a plate 195 formed at its outer end as a tongue 197 for the knob 115 (not shown). At each side of the shoe, the plate 195 has inner and outer side portions 197 and 199 which are bent inwardly for engagement with the edges of the shoe at respective sides of the rail 171. A retaining clip 201 is riveted to the plate 195 and engages behind the shoe 175 to prevent outward movement of the control element 193 in an axial direction. A spring bridge 203 acts between the radially outermost edge of the shoe and the central portion 205 of the retaining clip 201 so as to urge the control element outward in the radial direction. The control element 193 is thus mounted for essentially sliding movement along the rail 171 with each pair of side portions 197 and 199 together defining a slot for cooperation with the rail.

In operation of this embodiment, the shoe 175 is normally clamped to the rail 171, but an initial movement of the control element 193 serves through engagement of the inner side portion 197 with the adjacent roller element 91 to displace this roller element from clamping engagement between opposed surfaces 181 and 183 of the shoe and track respectively. At the end of this limited movement of the control element relatively to the shoe the rearmost side portions 197 and 199 engage the shoe to enabled continued movement.

FIGS. 8 and 9 show the relevant parts of a further embodiment of this invention. A quadrant plate 251 has a rim 253 provided with screw holes 255 for attachment of the plate to a headshell which is not shown. The central portion 257 of the quadrant plate, which is spaced from the head shell, is formed with an aperture 259 within which is located a pin 261. The quadrant plate in fact engages with a neck 263 cut in the pin 261. The inner, blast visor 265 is freely rotatable about the pin 261, the rotatable mounting comprising a circular aperture 267 in the visor; a backing plate 269 having a peripheral lip 271 engaged within a complementary groove 273 and an integral bearing sleeve 275; and a bush 277 positioned coaxially with and between the blast visor 265 and its backing plate 269.

The outer, glare visor 279 has a circular aperture within which the pin 261 is located. Between the glare visor 279 and the central raised portion 257 of the quadrant plate 251 is positioned a control lever 281 which is rotatably mounted on the pin 261 by means of an integral sleeve 283. This sleeve 283 extends axially inward as shown in FIG. 9 through the two visors 265 and 279 respectively and is held in position with a circlip 284. The control lever 281 is provided with a slot 285 through which the glare visor 279 is rigidly attached with two screws 287 to a shoe 289. The shoe 289 lies within an inwardly directed arcuate channel 291 formed in the quadrant plate 251.

The shoe 289 is shaped in a similar manner to the shoes shown in FIGS. 3 and 4 and two ball bearings 293 are positioned between opposing surfaces of the shoe and of the track. A compression spring 295 acts between the two ball bearings 293 as hereinbefore described. The control lever is provided with two L-shaped abutments 297 which project outwardly from the lever.

Upon an initial movement of the control lever, which is formed with a serrated rounded end 299 for this purpose, the shorter leg of the rearmost abutment 297 engages the adjacent ball bearing 293 and displaces it from wedging engagement. The longer leg of the abutment thereafter contacts the edge of the shoe and the shoe together with the glare visor 279 can be moved to the required position. The slot 285 is of sufficient length to permit the required amount of movement of the control lever 281 relatively to the shoe 289.

In this embodiment, the blast visor is provided with a clamping arrangement situated on the opposite side of the helmet. This arrangement can take any one of a number of forms although it could of course be identical with the illustrated glare visor system.

This invention has been described by way of example only and many variations can be made to the described embodiments without departing from the scope of the claimed invention. One or both of the described visors can thus be replaced by other helmet borne optical means such as sights, binoculars and protective shields of various kinds. A protective shield for use in emergencies may be opaque and still serve as optical means as the term is used in this specification. A protective helmet according to this invention may of course have a single visor or other optical means, whilst numerous combinations of two or more optical means are possible. The invention is clearly of greater relevance to helmets for use by aircrew but it is not so limited and is applicable to all protective helmets falling within the scope of the appended claims.

Those skilled in the art will appreciate that numerous modifications are possible to the described mechanisms. It is, for example, envisaged that the roller elements or ball bearings be replaced in some arrangements by other wedging elements. If a track of plastics material is employed, it may be advantageous to employ as wedging elements, two plastics blocks generally of trapezium shaped cross section. An inclined surface of each block will cooperate with the associated inclined end of the shoe surface and the opposing face of the block will, in the case of a track of channel formation, engage the opposing track surface. A spring or other suitable means will urge the two blocks toward their respective wedging positions.

The angle of the inclined ends of the shoe surface can be varied and indeed the ends can be arranged to slope in the opposite directions from those described. It will be appreciated that as the track surface which opposes the shoe is in the described embodiments arcuate, the critical angle which determines the efficiency of the wedging effect is not simply the angle of the inclined ends of the shoe surface but is affected by the radius of the track and by the angle of arc over which the shoe extends. In appropriate circumstances the shoe surface may even be planar.

The control element is required to be mounted for limited movement relatively to the shoe but the ways in which this can be carried out are numerous. It will be appreciated from the described embodiments that a direct connection to the shoe is not required. A variety of abutments for engaging the roller elements can be substituted for the described inwardly bent side portions. The shoe is connected with the associated visor and this connection is preferably a rigid connection so that upon clamping of the shoe to the track, all movement of the visor is prevented. If slight movement of the visor is permissible, however, a connection allowing small relative movement between the visor and its shoe can be employed. For example, the visor can be connected directly to the control element, and thus indirectly with the shoe.

The arcuate track of the invention can take forms other than the described channel and rail. The location of the track can be altered, whilst remaining centred on the same transverse axis, if space is required on the headshell for accommodation of ancillary helmet borne equipment. In certain circumstances the track can be formed integrally with the head shell.

What we claim is:

1. A protective helmet having (1) a rigid head shell, (2) optical means carried on the head shell for rotational movement into and out of the line of sight of the helmet wearer about an axis extending transversely of the head shell, and (3) a mounting for supporting the optical means on the head shell, characterized in that said mounting comprises:

A. means defining an arcuate track fixed relatively to and located at a side of the head shell and centered on the rotational axis of the optical means;

B. a shoe connected with the optical means for movement along the track concomitantly with said rotational movement of the optical means;

C. disengageable clamping means reacting between the shoe and track to hold the optical means against unintentional rotational movement;

D. a control element for said clamping means operable upon limited movement thereof relative to the shoe in either of two opposite senses to disengage the clamping means and free the shoe for movement along the arcuate track and thereby enable rotational movement of the optical means to be effected by further movement of the control element and upon cessation of such movement of the control element to enable reengagement of the clamping means;

E. said clamping means comprising oppositely mutually spaced surfaces of the track and of the shoe, the shoe surface at opposite ends thereof being inclined towards the track surface in respective opposite senses; and F. wedging elements located between said spaced opposing surfaces of the shoe and the track and biased into engagement with the track surface and the respective inclined ends of the shoe surface.

2. A protective helmet according to claim 1, wherein said wedging elements comprise ball or roller elements spring biassed into engagement with the track surface and the respective inclined ends of the shoe surface.

3. A protective helmet according to claim 1 wherein the control element is provided with two abutments that embrace the shoe, each of said abutments being adapted during said limited movement of the control element relative to the shoe to displace the adjacent wedging element from wedging engagement with the opposed surfaces of the shoe and the track, the abutment then engaging the shoe to enable movement of the shoe along the track by continued movement of the control element.

4. A protective helmet according to claim 1, wherein the means defining the arcuate track comprises a channel formed in a mounting plate secured to the head shell, the shoe being located at least partially within said channel.

5. A protective helmet according to claim 1 wherein said means defining the arcuate track comprises a rail, and wherein the shoe is formed with a recess to accommodate said rail.

6. A protective helmet according to any claim 1, wherein the shoe is supported on a lever mounted at one end thereof for rotation about said axis.

7. A protective helmet according to claim 6, wherein the side of the optical means adjacent the arcuate track and said lever are secured to a common bearing sleeve.

8. A protective helmet according to claim 6 wherein the control element is pivotally secured to the free end of the lever.

9. A protective helmet according to claim 1, wherein the shoe is secured directly to the optical means.

10. A protective helmet according to claim 9, wherein the control element forms part of a lever mounted for rotation about said axis.

11. A protective helmet according to claim 1, comprising further optical means carried on the head shell for rotational movement about said axis, a further shoe connected with the further optical means for movement along said track upon rotational movement of the further optical means, further clamping means provided between the further shoe and the track and a further control element arranged for limited movement relative to the further shoe, the further clamping means being adapted to function in the same manner as said first named clamping means.

12. A protective helmet according to claim 11, wherein said first named shoe and said further shoe are mounted on respective levers which are each mounted at one end thereof for rotation about said axis.

13. A protective helmet according to claim 12, wherein the side of each optical means adjacent the arcuate track, and the corresponding levers are mounted on the corresponding sleeve of a pair of concentric bearing sleeves.

14. A protective helmet according to claim 12, wherein said further control element is formed on one arm of a bell crank lever mounted for rotation about said axis, the other arm of the bell crank lever being circumferentially aligned with said control element when the first named optical means and the further optical means are in mutually corresponding positions.

15. A protective helmet according to claim 1, wherein the optical means is a visor.

16. A protective helmet according to claim 11, wherein the first named optical means and the further optical means are a blast visor and a glare visor respectively.

17. A protective helmet having a shell, optical means mounted on the shell for adjustment about an axis extending transversely through the shell, disengageable latching means to releasably hold the optical means against unintended displacement from a selected position of adjustment, and means operable upon disengagement of the latching means to adjust the position of the optical means, said helmet being characterized in that:

A. said latching means comprises means defining an arcuate track that is fixed with respect to the shell and has two uninterrupted smooth surfaces concentric to said axis;

B. a shoe movable along said arcuate track, said shoe having a first surface slidably engaging one of said uninterrupted smooth surfaces of the track and a second surface in spaced opposing relation with the other of said uninterrupted smooth surfaces of the track, said second surface of the shoe being shaped to coact with said other surface of the track to define a pair of circumferentially spaced oppositely facing wedge-shaped spaces;

C. wedging elements in said spaces;

D. spring means yieldingly urging said wedging elements towards the narrow end of their respective wedge-shaped spaces, so that one of said wedging elements coacts with the surfaces it engages to hold the shoe against movement in one direction along the arcuate track while the other wedging element coacts with the surfaces it engages to hold the shoe against movement in the opposite direction;

E. manually actuatable latch releasing means mounted to move with and with respect to the shoe and operable to selectively move either wedging element out of wedging coaction with the surfaces it engages to thereby free the shoe for movement in a selected direction along the track and then move the shoe in that selected direction; and F. means connecting the optical means with the shoe so that in one motion the latching means can be disengaged and the optical means moved to a selected position.

18. A protective helmet as claimed in claim 17, in which the wedging elements comprise roller elements and a spring reacting between the roller elements to urge them apart.

* * * * *